US005582375A

United States Patent [19]

Martin

[11] Patent Number: 5,582,375

[45] Date of Patent: Dec. 10, 1996

[54] ADJUSTABLE ERGONOMIC SUPPORT FOR COMPUTER KEYBOARDS

[76] Inventor: Michael Martin, P.O. Box 22, Rt. 22 West, Whitehouse Station, N.J. 08889

[21] Appl. No.: 198,890

[22] Filed: Feb. 18, 1994

Related U.S. Application Data

[63] Continuation-in-part of Ser. No. 871,108, Apr. 20, 1992, Pat. No. 5,351,897.

[51] Int. Cl.[6] ..... B43L 15/00

[52] U.S. Cl. ..... 248/118.3; 248/918; 248/118; 400/715

[58] Field of Search ..... 248/118, 118.1, 248/118.3, 118.5, 918, 346.06, 345.1, 923, 922, 921, 286, 296, 346.01

[56] References Cited

U.S. PATENT DOCUMENTS

| | | | |
|---|---|---|---|
| 3,830,352 | 8/1974 | Kolpek . | |
| 3,991,961 | 11/1976 | Platzer, Jr. . | |
| 4,688,862 | 8/1987 | Fowler et al. | 248/118.5 X |
| 4,706,919 | 11/1987 | Soberalski et al. . | |
| 4,709,972 | 12/1987 | LaBudde et al. . - | |
| 4,913,390 | 4/1990 | Berke . | |
| 4,949,650 | 8/1990 | Allard . | |
| 4,976,407 | 12/1990 | Schwartz et al. | 400/715 X |
| 5,037,054 | 8/1991 | McConnell . | |
| 5,040,757 | 8/1991 | Benaway . | |
| 5,048,784 | 9/1991 | Schwartz et al. | 248/118.3 X |
| 5,073,050 | 12/1990 | Andrews et al. | 400/715 X |
| 5,104,073 | 4/1992 | Van Beck et al. | 248/918 X |
| 5,154,390 | 10/1992 | Bain et al. . | |
| 5,211,367 | 5/1993 | Musculus | 248/288.5 X |
| 5,257,767 | 11/1993 | McConnell | 248/918 X |
| 5,351,897 | 10/1994 | Martin . | |
| 5,405,204 | 4/1995 | Ambrose . | |
| 5,513,824 | 5/1996 | Leavitt et al. | 248/118.3 |

FOREIGN PATENT DOCUMENTS

WO92/13722 8/1992 WIPO .

OTHER PUBLICATIONS

Stack, Barbara, *Keyboard RSI: The Practical Solution,* 1987, pp. 1–78.

O'Malley, Brian, "Keyboard–Associated Carpal Tunnel Syndrome", date unknown, pp. 1–7.

Stack, Barbara, Repetitive Strain Injury—Pevention and Rehabilitation, *Preprints of International Conference on Ergonomics, Occupational Safety and Health and the Environment,* vol. 1, Australian Darling Downs Institute of Advanced Education, 24–28th Oct., 1988, pp. 444–453.

Patkin, Michael, Problems of Computer Workers: Lessons from the Australian Debate, *Work With Display Units 89,* 1990, pp. 547–555.

Brochure entitled "Position Control Solutions—Customize Any Workstation For Comfort & Functionality" Weber Knapp Company Copyright 1992.

E. Helmetsie, "Mediating the Space Between Workers and Tools", Innovation, Fall 1992.

News Release entitled "New Keyboarding System Designed to Help Prevent Carpal Tunnel Syndrome Uses High-Strength, Glass–Filled Nylon for Key Structural Parts" Miles Polymers Division, Mar. 8, 1993.

*Primary Examiner*—Karen J. Chotkowski
*Attorney, Agent, or Firm*—Lerner, David, Littenberg, Krumholz & Mentlik

[57] ABSTRACT

A keyboard positioning system, either alone or in combination with other computer aids, which is ergonomic in design and allows for height adjustments to accommodate operators of different anatomical sizes, yet presets the angle of palm rest and angle of keyboard tray to a wrist neutral position to ensure the proper positioning of the operator's hands, wrist and fingers to greatly lessen or eliminate stress and strain injuries.

17 Claims, 8 Drawing Sheets

ADJUSTABLE ERGONOMIC SUPPORT FOR COMPUTER KEYBOARDS

This is a continuation-in-part of application Ser. No. 07/871,108, filed Apr. 20, 1992, now U.S. Pat. No. 5,351,897.

BACKGROUND OF THE INVENTION

FIELD OF THE INVENTION

This invention relates to an improved adjustable support platform for support of a computer keyboard, the support being fully adjustable in height for individuals of varying sizes, either right-handed or left-handed, the support having a preset angle with respect to a horizontal plane to ensure support at a neutral wrist angle and neutral finger angle position.

The advent of the personal computer in the early 1980's resulted in a total revamping and change in the office environment. Data processing and word processing could now be accomplished at much greater speeds and efficiencies. The keyboard developed for use with personal computers evolved from the technology associated with manual typewriters which required a posture suited to a slower typing rate and heavy downward stroke on the keys. Further, the manual machines and even the later generation electric typewriters provided for frequent rest periods for the operator. Fingers could rest on the keys without causing them to actuate and rests were further provided by interruptions, such as carriage returns, paper changes and manual error corrections. These short rests or mini breaks allow time for recovery from any fatigue, trauma or tension of the lower arms, wrist and fingers.

With the advent of the personal computer, office place injuries in the form of carpal tunnel syndrome have more than doubled. This trauma occurs when the nerve and tissues in the carpal tunnel within the wrist are compressed by the bones and ligaments. It results in numbness, tingling and pain in the hand and fingers that migrates to the elbow and shoulders. Corrective surgery to correct this malady is required in over 50% of the cases and in some instances, must be repeated a second time within 18 months.

One culprit identified in the rise of carpal tunnel syndrome is the computer keyboard and its positioning vis-a-vis the posture of the operator. The computer and the associated keyboard have eliminated the mini or micro breaks that the operator experienced in using manual machines or late model electric typewriters. There is no longer a carriage return. Paper changes are not required and manual error corrections are performed through further use of the keyboard. Feather-touch keys on the keyboards reduce the amount of force required to actuate the keys and mandate that the operator cannot rest their fingers on the keys. Productivity is increased dramatically as a result of the development of the personal computer. Typing speeds in the form of strokes per hour have quadrupled since all corrections and directions are now performed by keyboard functions with directions to the personal computer. However, the overall method of data entry has not significantly improved. Computer operators continue to assume the traditional typing position in which the wrists are flexed. This position is acceptable for manual typewriters where the mini breaks occur in the data entry process, but is not suitable for utilizing computer keyboards for data entry where the speed of data entry has been greatly increased.

There have been many attempts to develop a keyboard support which would combine several advantages for the keyboard operator. These developments include mounts which allow the keyboard support to be slipped under the desktop, supports which allow the raising and lowering of the keyboard, and in some instances, attempts have been made to provide for the tilting of the keyboard. Examples of these developments can be found in the following U.S. Pat. Nos. 5,037,054; 5,040,760; 5,031,867; 4,988,066.; 4,913,390; 4,826,123; 4,776,284; 4,706,919; 4,691,888; 4,635,893; and 4,616,798. None of the above patents address the key issues with respect to the positional relationship of the keyboard in both horizontal and vertical planes through the relationship of the positioning of the operator's forearms, wrists and fingers.

Applicant, in his prior application, Ser. No. 07/871,108, addresses an ergonomically-designed support for the keyboard and other related computer aids including document holders in which the position of the operator's forearms, wrists and fingers were maintained in a neutral position with the keyboard support in a slightly tilted, non-horizontal plane, the rear of the keyboard being slightly lower than the front of the keyboard thereby eliminating any flexation or extension of the forearms, wrists and fingers of the operator.

This application addresses the same problems, however, Applicant has further improved the keyboard support assembly to preset the angle of the palm rest and to preset the angle of the keyboard tray to cover a wide range of anthropometric hand and finger sizes to ensure that the angle of the palm rest and keyboard tray remain in a neutral position vis-a-vis the operator. Active height adjustment would be available to accommodate the physical parameters of the individual using the keyboard and an active fine adjustment mechanism would be available to accommodate extreme variations and diversities in the anthropometric range.

The ability to preset the angle of the palm rest and keyboard tray, yet allow height adjustment and fine adjustment of this angle is accomplished through a novel adjustment means cooperative between the keyboard tray and the support means securing the keyboard tray to the desk or computer stand.

OBJECT OF THE INVENTION

An object of the present invention is to provide for a novel computer keyboard support assembly with preset keyboard support and palm rest angles to ensure maintenance of a neutral wrist position by the operator.

Another object of the present invention is to provide for a novel keyboard support assembly that permits height adjustments to accommodate individuals of varying physical parameters.

A further object of the present invention is to provide for a novel keyboard support assembly in which the preset keyboard and palm rest angles are broad enough to cover a wide range of anthropometric parameters.

A still further object of the present invention is to provide for a novel keyboard support assembly in which a fine adjustment is available in order to accommodate extreme variations and diversities in anthropometric range.

SUMMARY OF THE INVENTION

The present invention is directed towards a keyboard positioning system, either alone or in combination with other computer aids, such as a document holder, mouse pad and writing surface, which is ergonomic in design and allows for height adjustments to accommodate operators of different anatomical sizes, angle of keyboard support at a negative slope to ensure that the operator's wrists and fingers remain in a neutral position when operating the system, thereby greatly lessening or eliminating the possibility of the development of carpal tunnel syndrome. The keyboard positioning system would preset the angle of the palm rest and the angle of the keyboard to cover the broadest anthropometric range, yet would still allow for fine adjustment in order to accommodate extreme variations in the anthropometric range, the keyboard support and support means being cooperable to ensure the maintenace of the neutral position even when the keyboard tray is adjusted for varying heights.

BRIEF DESCRIPTION OF THE DRAWINGS

The objects of the invention, together with other advantages will become apparent, particulary when taken in light of the following drawings wherein.

DETAILED DESCRIPTION OF THE DRAWINGS

Figure 1:
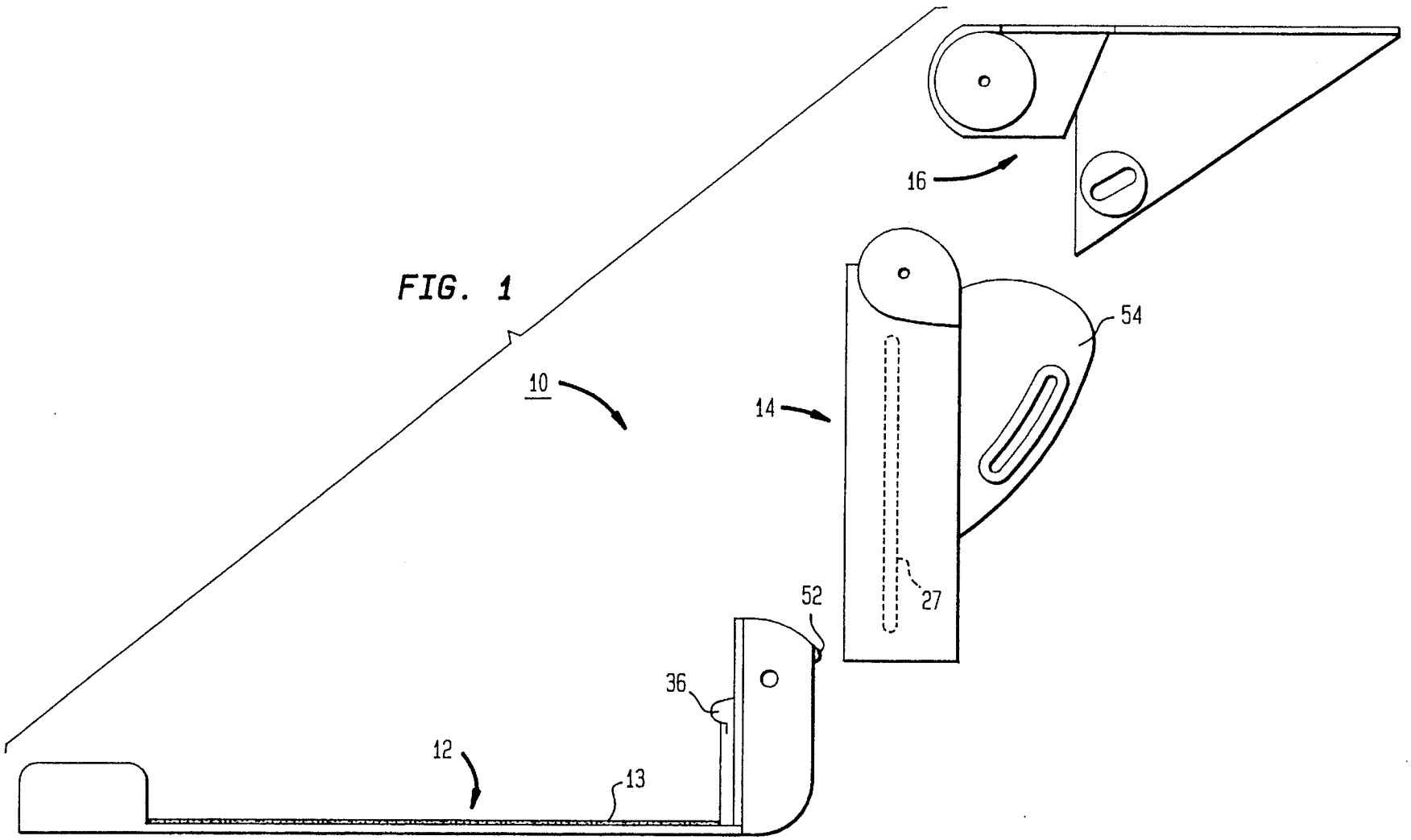
FIG. 1 is an exploded side view of the keyboard support assembly illustrating the three primary components.

The adjustable ergonomic keyboard support assembly 10 is comprised of three (3) primary elements; the keyboard support 12, the height adjustment member 14, and the horizontal mounting member 16. The height adjustment member 14 and the horizontal mounting member 16 together constitute a bracket assembly for mounting the keyboard support 12 to a work surface. These three elements are illustrated in FIG. 1 which is a side elevational exploded view of keyboard assembly support 10.

Figure 2:
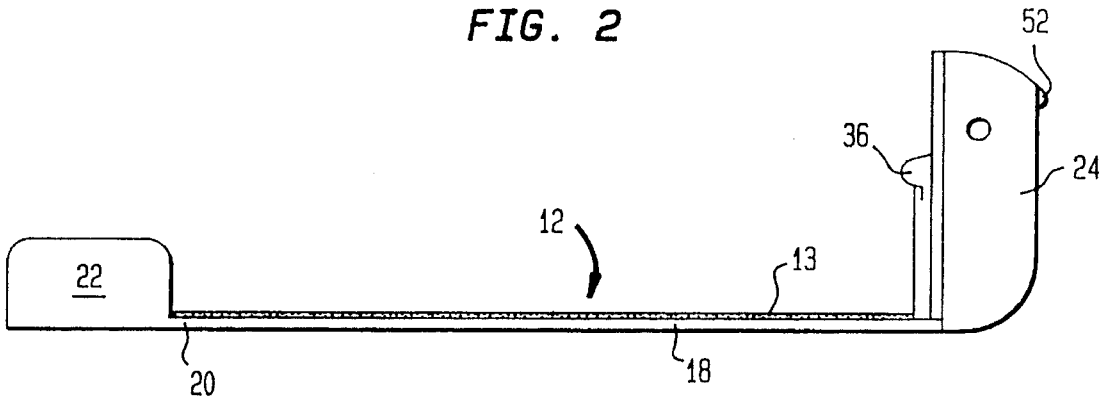
FIG. 2 is a side elevational view of the keyboard support.

As illustrated in FIG. 1 and FIG. 2, which is a side elevational view of keyboard support 12, the keyboard support consists of a planar support base 18 which generally subscribes to the shape and dimensions of a standard computer keyboard. Base 18 has formed on its front end 20 a palm and wrist support 22. Palm and wrist support 22 is designed to support the wrist and palm of the operator in the preferred neutral position as discussed in detail hereafter. Palm and wrist support 22 is configured to the correct height in order to provide neutral support for the operator when the computer keyboard is positioned on base 18 and its longitudinal edge is in proximate contact with the palm support and wrist 22.

Figure 3:
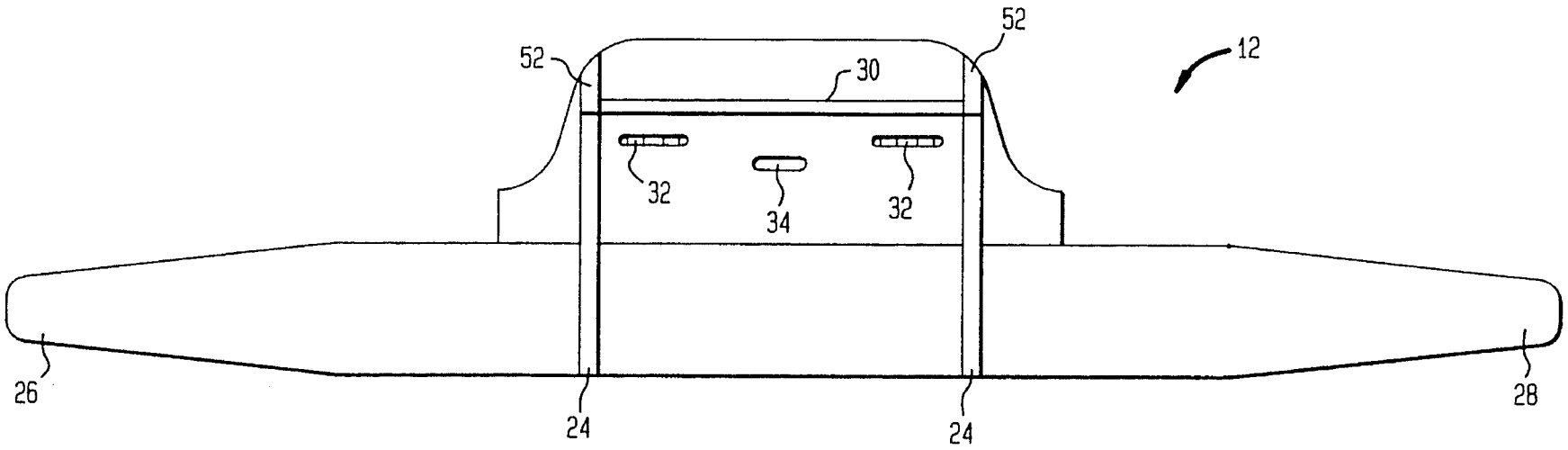
FIG. 3 is a rear elevational view of the keyboard support.

Keyboard support 12 has two Upstanding parallel bracket supports 24 positioned equidistant from ends 26 and 28 of keyboard support 12. Brackets 24 are best illustrated with respect to FIG. 3 which is a rear view of keyboard support 12. Brackets 24 are designed for cooperation with height adjustment member 14. Residing between brackets 24 is a positioning rod 30 which is cooperable with a pain of vertical slots 25 and formed on height adjustment member 14 as discussed hereafter.

There is further positioned on the rearward side of keyboard support 12, a pair of locating bosses 32. These locating bosses 32 are in the form of horizontally-formed protrusions on the rear face of keyboard support 12 and are cooperable with complementary recesses 48 in height adjustment member 14 as described hereafter. In addition to locating bosses 32, the rear face of keyboard support 12 has a locking cross member 34 which is rotated by actuating mechanism 36 on the front side of the rear face of keyboard support 12. As will be explained further below, through the manipulation of actuating mechanism 36, locking cross member 34 may be moved between a locked position in which it securely engages height adjustment member 14, and a released position in which it is no longer engaged with height adjustment member 14. Thus, once keyboard support member 12 has been positioned at the desired height with locating bosses 32 in the appropriate recesses in height adjustment member 14, actuating member 36 can be operated to place locking cross member 34 in the locked position to engage locking cross member 34 with height adjustment member 14 and securely hold the components in this selected position.

Figure 4:
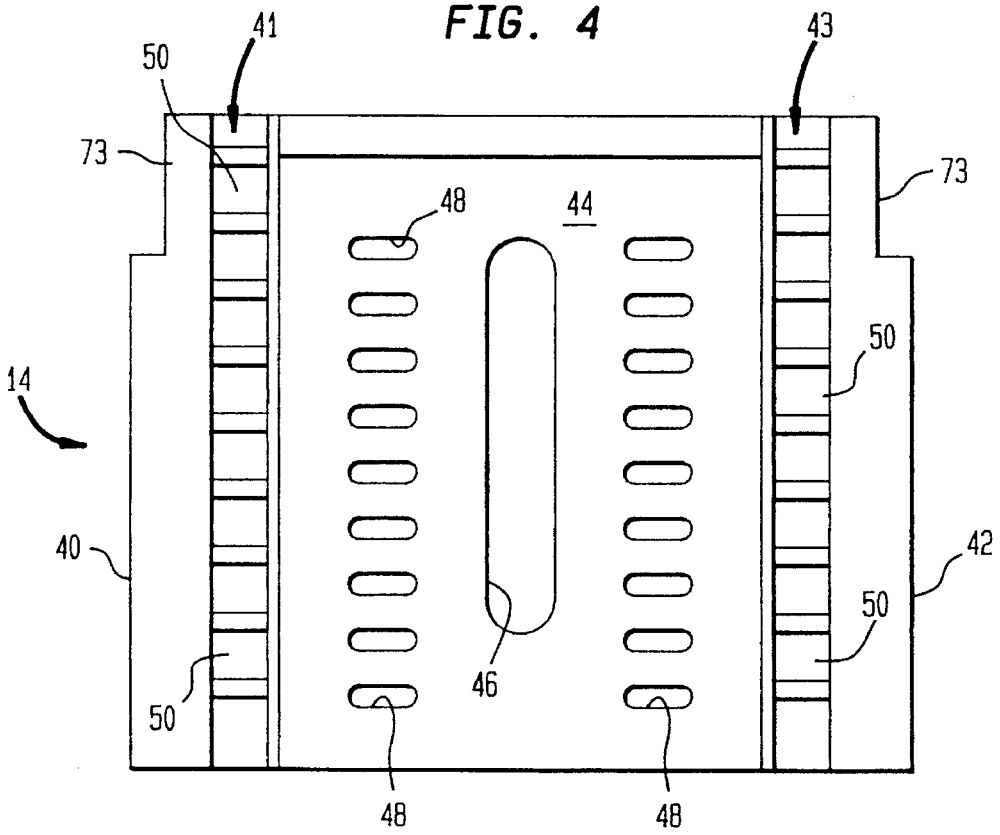
FIG. 4 is a front elevational view of the height adjustment member.

A front view of height adjustment member 14 is illustrated in FIG. 4. Height adjustment member 14 is comprised of two (2) end brackets 40 and 42 which are spaced by channels 41 and 43, respectively, from a forward face 44. Height adjustment member 14 is generally rectangular in shape having a vertical slot 46 centrally positioned thereon, which vertical slot accommodates locking cross member 34 of keyboard support 12 in a slidable manner.

The forward face 44 of height adjustment member 14 has two rows of vertically aligned horizontal recesses 48 which in turn are cooperable with locating bosses or protrusions 32 on the rear face of keyboard support 12.

Additionally, height adjustment member 14 has a second pair of vertically aligned horizontal recesses 50 positioned along the bottoms of channels 41 and 43. These recesses cooperate with complementary locating elements 52 formed on the upper rearward portions of brackets 24 of keyboard support 12.

Figure 6:
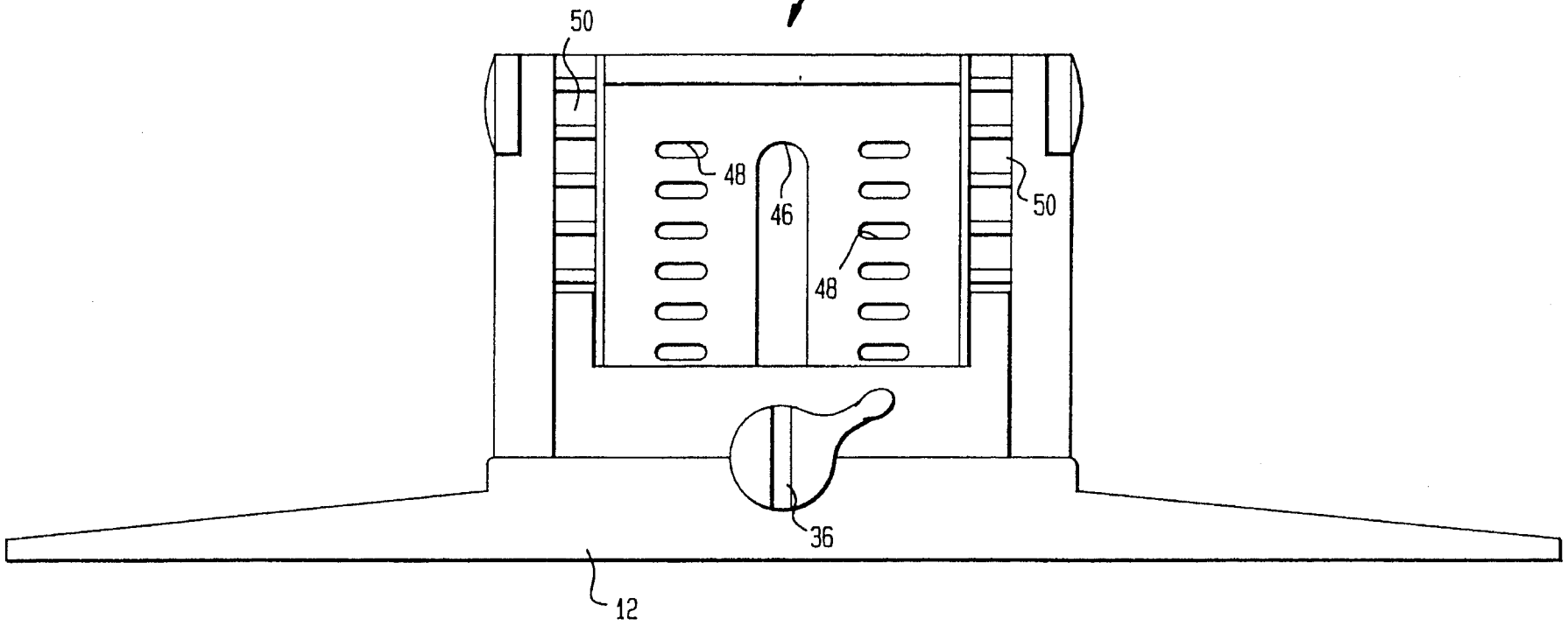
FIG. 6 is a front elevational view showing the cooperation between the keyboard support and the height adjustment member.
Figure 11:
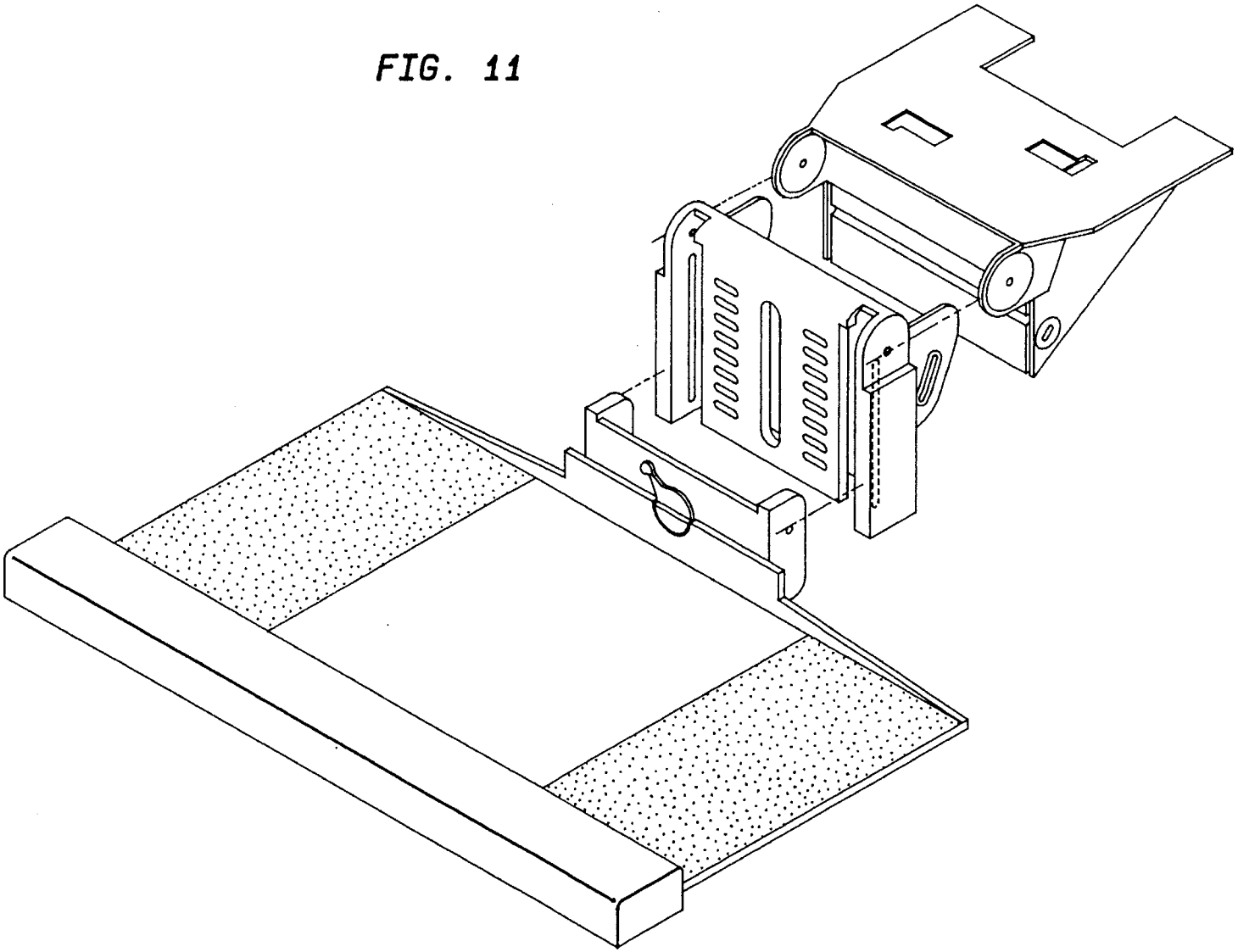
FIG. 11 is a front exploded perspective view of the keyboard support.
Figure 12:
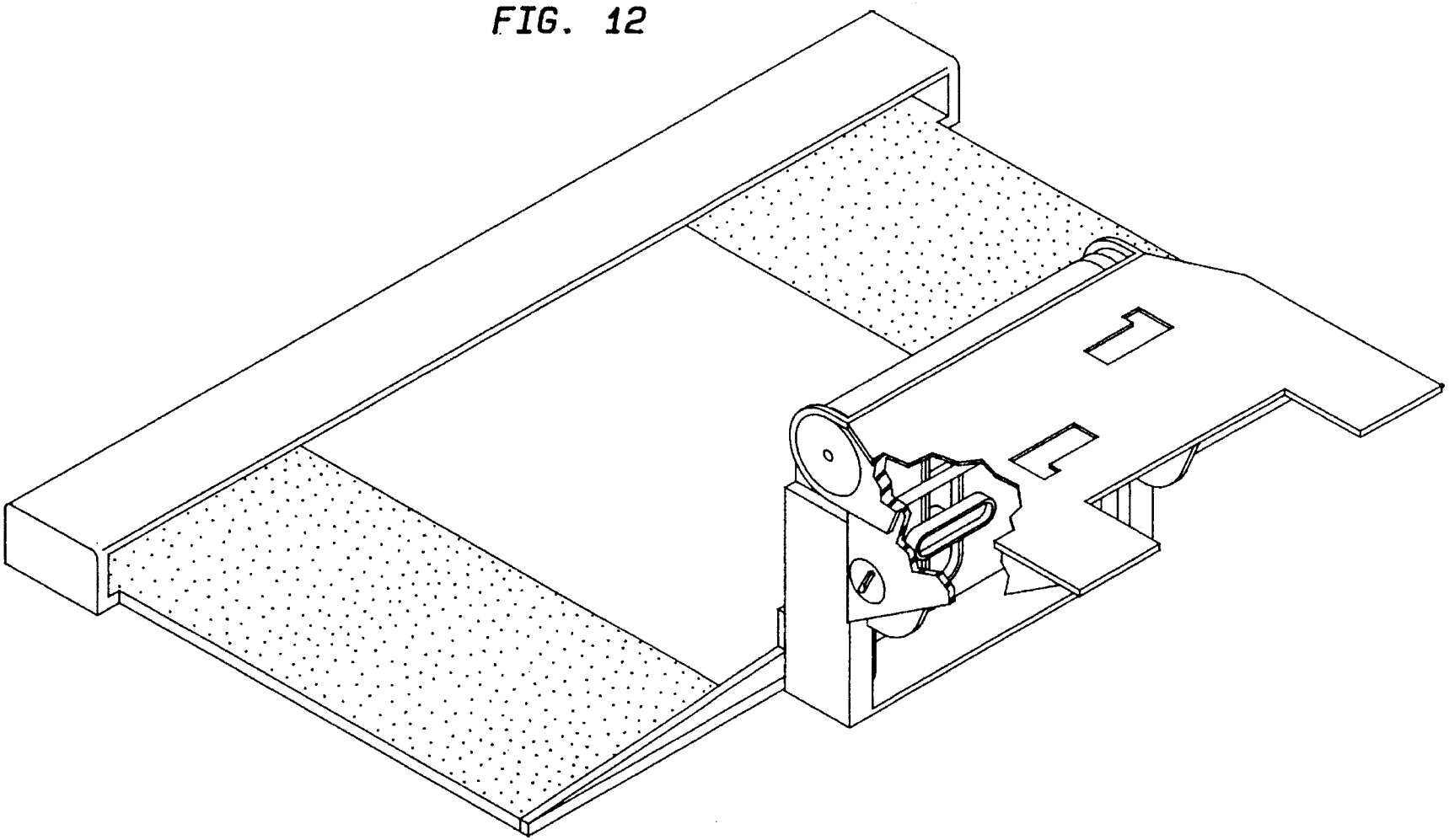
FIG. 12 is a rear perspective view of the keyboard support in assembled condition.

In operation, actuating mechanism 36 maybe tuned from an opened position to a fully locked position. In the opened position, keyboard support 12 may be adjusted upwardly or downwardly in relationship to height adjustment member 14 by means of the movement of guide rod 30 in vertical slots 25 and 27. This is accomplished by rotating the front edge 20 of the keyboard support upwardly with respect to height adjustment member 14. This movement disengages locating bosses 32 on keyboard support 12 from recesses 48 on the front face of height adjustment member 14, and also disengages locating elements 52 from recesses 50 in channels 41 and 43. Keyboard support 12 may then be slidably moved upwardly or downwardly to obtain the desired height, with guide rod 30 traveling within mounting slots 25 and 27 to hold keyboard support 12 in assembled relationship with height adjustment member 14. It is then rotated downwardly such that the locating bosses 32 on its rearward face engage complementary recesses 48 the front face of height adjustment member 14. Simultaneously, locating elements 52 on brackets 24 of keyboard support 12 would engage complementary recesses 50 on height adjustment member 14. Actuating mechanism 36 would then be moved from the opened to the locked position. This in turn would rotate locking cross member 34 from a vertical orientation, the orientation it is found when in the opened position, to a horizontal or locked position in which it spans slot 46 in height adjustment member 14, thereby locking the keyboard support in relationship to the height adjustment member. This relationship may best be illustrated in FIG. 6 which is a front view of keyboard support 12 in cooperation with height adjustment member 14 showing the manner in which keyboard support 12 is ratchetly engaged with height adjustment member 14. In FIG. 6, actuating mechanism 36 is positioned in the opened position (with cross member 34 oriented vertically) which would allow for the upward or downward movement of keyboard support 12. Once the correct height had been obtained, the actuating mechanism 36 would be rotated approximately 90° to the locked (shown in FIG. 11) position which in turn would cause cross member 34 to rotate to a horizontal orientation across slot 46 and into locking engagement with height adjustment member 14.

Figure 5:
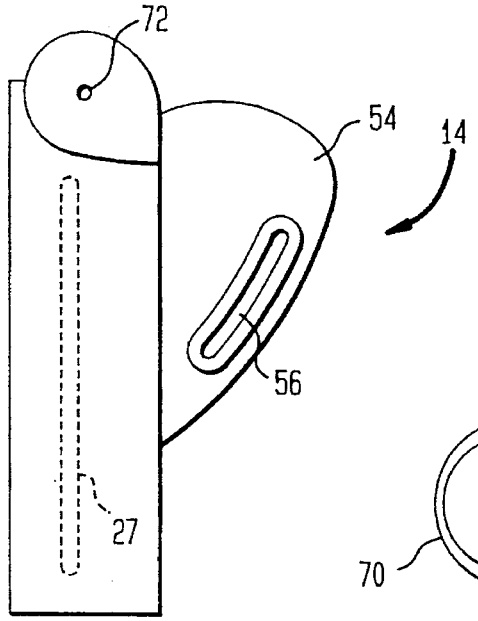
FIG. 5 is a side elevational view of the height member.

Height adjustment member 14 is cooperable with the third element of the keyboard support apparatus, namely, the horizontal mounting member 16. As illustrated in FIG. 1 and FIG. 5, a side view of height adjustment member 14, each of the parallel side bracket members 40 and 42 have extending rearwardly therefrom, an upstanding arcuate member 54 in parallel relationship with each other, each member 54 having an arcuate slot 56 formed therein, slots 56 being in parallel relationship to each other.

Figure 7:
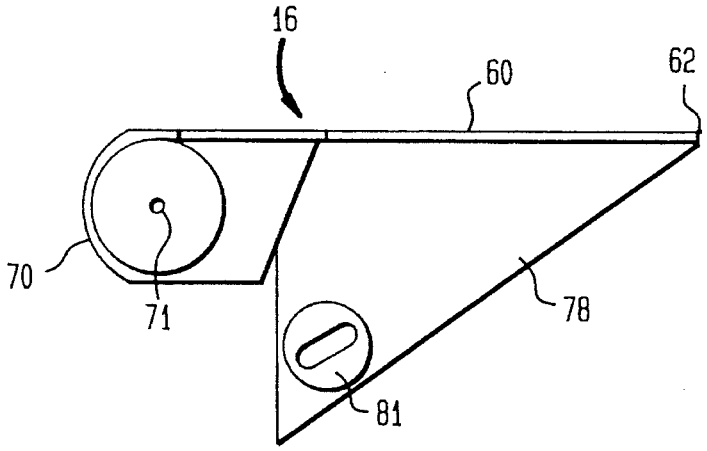
FIG. 7 is a side elevational view of the horizontal mounting member.
Figure 9:
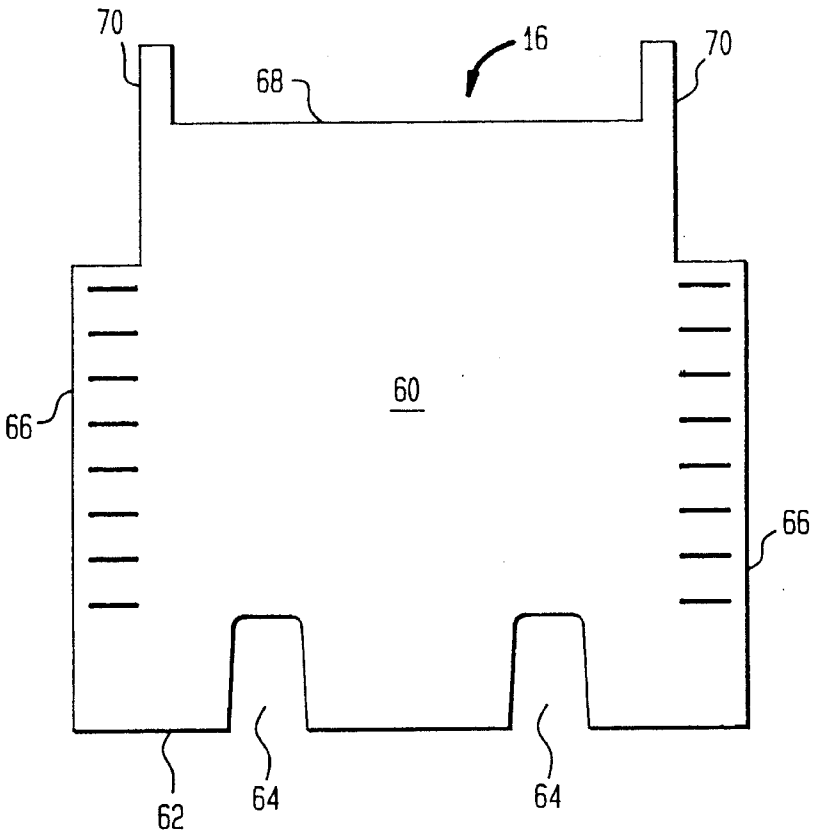
FIG. 9 is a top elevational view of the horizontal mounting member.
Figure 8:
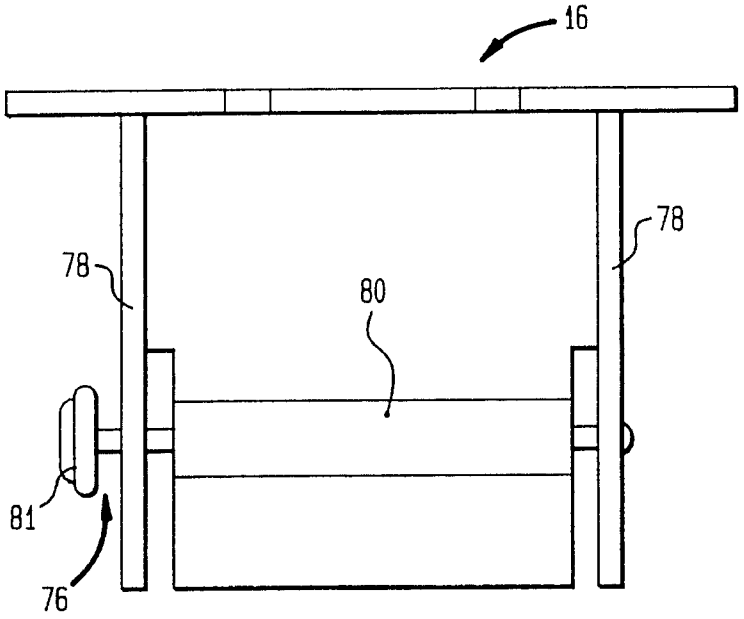
FIG. 8 is a rear elevational view of the horizontal mounting member.

FIGS. 7, 8 and 9 are respectively, a side view, rear view and top view of horizontal mounting member 16. Horizontal mounting member 16 has a generally planar upper panel 60 for cooperation with the underside of the computer stand or computer table, a pair of downwardly depending triangular sidewalls 78, and a downwardly depending front wall 79. It may be either mounted directly to the table or cooperable with a tracking system allowing for its slidable engagement under the table. At its rearward edge 62 upper panel may have a plurality of cutouts 64 for the securing of motivating member to the underside of the computer table or stand. Alternatively, lateral edges 66 of upper panel 60 could serve to position the horizontal mounting member 16 within a tracking system on the underside of the computer table.

On the forward edge 68 of upper panel 60, horizontal mounting member 16 has two parallel protruding ears 70, each of which has a centrally disposed aperture 71. Ears 70 are spaced apart so as to fit in recessed corners 73 at the upper lateral edges of height adjustment member 14. In assembled position, apertures 71 in horizontal mounting member 16 are aligned with an aperture 72 extending through height adjustment member 14 between corners 73. A guide rod extending through apertures 71 and 72 holds height adjustment member 14 and horizontal mounting member 16 in assembled position while at the same time permitting the members to pivot with respect to one another.

Height adjustment member 14 may be locked in place relative to horizontal mounting member 16 by a compression locking system 76 assembled on the downwardly depending sidewalls 78 of horizontal mounting member 16. Compression locking system 76 includes a guide rod (not shown) which is assembled at one end to one sidewall 78, and which then passes in succession through one of the arcuate slots 56 in height adjustment member 14, through an elongated bore 80 formed on the front wall 79 of horizontal mounting member 16, through the other arcuate slot 56 on height adjustment member 14, and finally through the other downwardly depending sidewall 78. An enlarged finger nut 81 may be threadedly engaged on the free end of the guide rod. Tightening finger nut 81 will compress arcuate members 54 on height adjustment member 14 between through bore 80 and sidewalls 78 on horizontal mounting member 16, thereby locking the height adjustment member from pivoting relative to the horizontal mounting member. As finger nut 81 is loosened, the compressive force will be diminished so that height adjustment member 14 will be free to pivot relative to horizontal mounting member 16.

The movement of the guide rod within arcuate slot 56 defines the range of this pivotable movement. This pivotable movement provides for fine tuning the angular position of the keyboard support 12 and the keyboard positioned thereon vis-a-vis the operator. This is an active adjustment which is designed to accommodate the extremes and variations in the anthropomeric range indicated below.

| | | | | |
|---|---|---|---|---|
| Popliteal Height: | 5th % Female 360 mm(14.2") | 95th % Male 485 mm(19.5") | Variance 135 mm(5") | Proformix Height Adj. 135 mm(5") |
| Elbow to Finger: | 5th % Female 400 mm(15.7") | 95th % Male 515 mm(20.3") | Variance 115 mm(4.5") | Proformix Adjustment >115 mm(4.5") |
| Hand Length: | 5th % Female 165 mm(6.5") | 95th % Male 210 mm(8.25") | Variance 55 mm(1.75") | Proformix Palm Rest 80 mm(3.13") |

Figure 10:
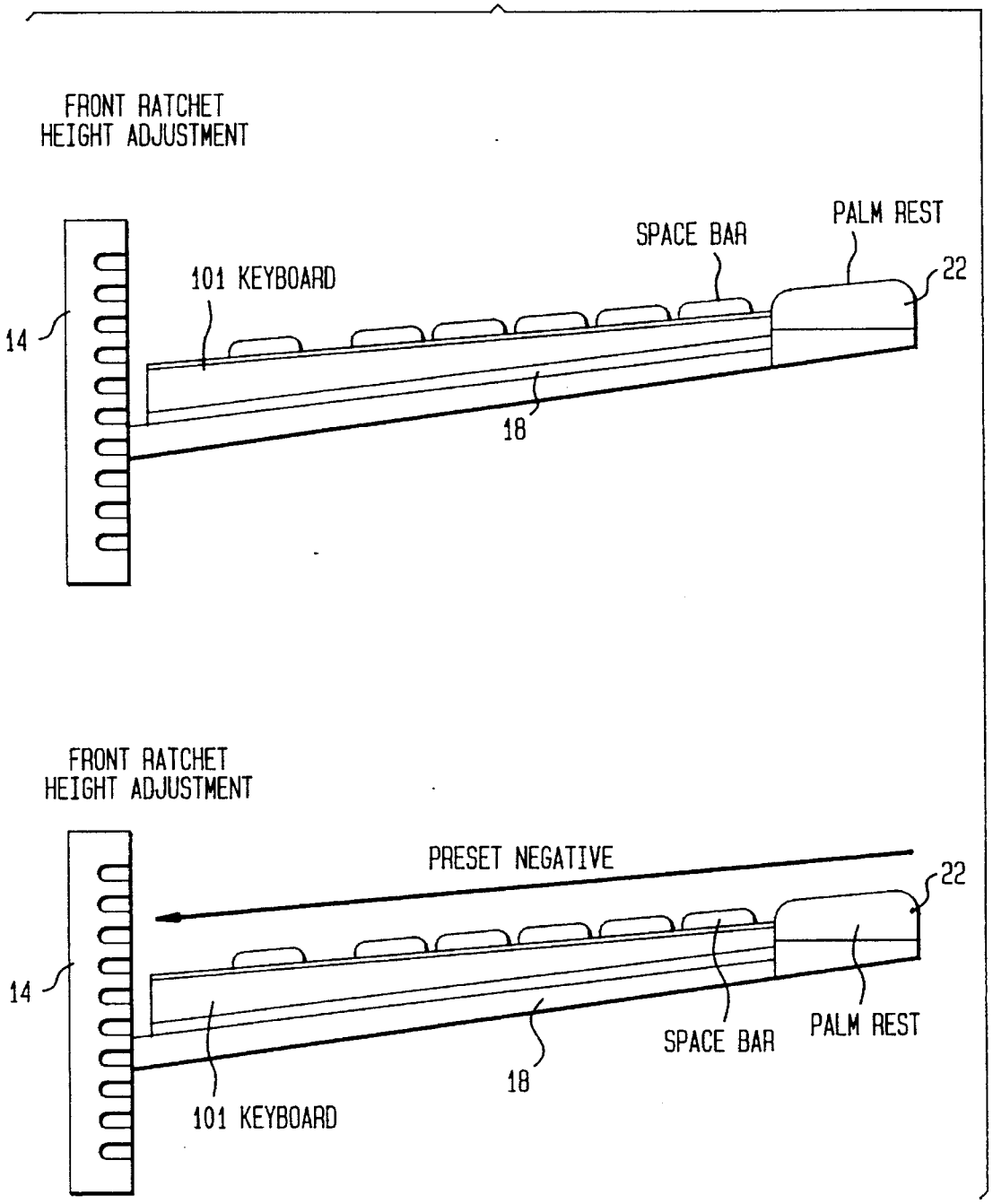
FIG. 10 is a highly schematic side elevational illustrating the neutral wrist position present in the keyboard support assembly in order to avoid fatigue, tension and pain.

FIG. 10 illustrates the preset negative angle of the keyboard in order to avoid stress and strain. Keyboard support 12 is cooperative with height adjustment member 14 in a ratchet arrangement in order to selectively adjust the height. Another feature of the keyboard support 12, in order to further reduce stress, strain and tension on the fingers, wrist and forearms, is the non-skid, friction support pad 13 positioned on the upper surface of planar support base 18. The keyboard support 12 would come with several non-skid friction support pads 13 of various thicknesses. The operator would choose the non-skid pad 13 of such thickness to ensure that the upper surface of the keyboard keys is aligned with the upper surface of palm rest 22. In this configuration, the upper surface of the keys would be on the same plane and at the same height as the palm test.

The operator can reference a laminated instructional card which details the adjustments available to the operator. This laminated card is slidably cooperable with horizontal mounting member 16 so as to be recessed under the computer stand or work surface when not in use, but slidably removable by the operator in order to reference correct settings.

The ergonomic keyboard support assembly 10 when properly installed and adjusted provides a work area in which the operator is seated with the feet firmly on the floor and slightly ahead of the knees. This leg position facilitates the unrestricted blood circulation in the legs with the feet supporting the weight of the lower legs. The chair height is adjusted to make the thighs nearly parallel to the floor as possible. This again avoids pressure behind the knees and promotes good blood circulation through the legs.

The operator would sit rearwardly in the chair, tilted slightly from 90° vertical and well supported in the lumbar region thereby opening the body angle at the hip. This angle reduces disk pressure and relieves the muscles of the back from holding the body perfectly upright, a position that cannot be maintained for long periods of time.

The head would be balanced, the shoulders relaxed and the arms hanging naturally so that the hands rest comfortably on the lap. This creates an open angle at the elbow joint, again providing for proper circulation.

This seated posture allows for the ergonomic keyboard support assembly to actually bring the work surface to the operator. It positions the keyboard lower, close to the lap where the arms can hang naturally with open angles at the elbow. The ergonomic keyboard support assembly 10 supports the weight of the arms and keeps the wrists and hands straight and relaxed in what is referred to as a "wrist neutral position". This is accomplished by the negative angle of the keyboard support which slopes away from the user. The preset negative slope causes the hands to fall naturally into the wrist neutral position.

The palm rest supports the fleshy portion of the hand and palm and presents a surface which allows the hands to glide freely from one end of the keyboard to the other without sticking.

The ergonomic keyboard support assembly, which is the subject matter of this application, provides the operator with a comfortable working environment in which proper posture is promoted and in which the hands, wrists and arms of the operator are properly supported and positioned to avoid stress and strain. The ergonomic keyboard assembly support adjusts in order to bring the work, in the form of the keyboard, to the operator while the operator maintains the proper posture. While the ergonomic keyboard support assembly of the present application allows for certain adjustments to accommodate anatomical differences between operators, certain adjustments are preset, such as the negative slope of the keyboard support, so that a wrist neutral position is maintained. This negative slope is maintained regardless of the height adjustments which maybe needed to accommodate anatomical difference between operators.

While the present invention has been described in connection with the exemplary embodiment thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

What is claimed:

1. An adjustable support assembly for supporting a keyboard so that the keyboard user's wrists will be in a substantially neutral position when the keyboard user is in an operating position relative to the keyboard, said support assembly comprising a support platform having an upper surface extending generally in a plane, a front edge and a rear edge, said front edge being closer to the keyboard user in said operating position than said rear edge, a bracket assembly for mounting said support platform to a work surface, said bracket assembly having a first end connectable to said work surface and a second end, said support platform being assembled to said bracket assembly for movement through a range of positions between said first and second ends, a locking mechanism having a locked condition for locking said support platform in fixed relationship to said bracket assembly within said range of positions and a released condition for releasing said support platform for movement within said range of positions, and movement limiting means for limiting angular movement of said support platform relative to said bracket assembly in said locked condition so that said support platform in said locked condition is always oriented with said front edge higher than said rear edge.

2. The adjustable support assembly as claimed in claim 1, wherein said bracket assembly includes a first portion connectable to said work surface and a second portion connectable to said support platform, said second portion being pivotably joined to said first portion for movement through a predetermined range of angles relative to said first portion, and a locking element having a locked position for locking said second portion in fixed angular relationship to said first portion within said predetermined range of angles and a released position for releasing said second portion for movement through said predetermined range of angles.

3. The adjustable support assembly as claimed in claim 1, wherein said support platform includes a palm rest extending along said front edge, said palm rest having a support surface located at a spaced distance above said upper surface of said support platform.

4. The adjustable support assembly as claimed in claim 3, wherein said support surface of said palm rest lies in a plane extending generally parallel to said upper surface of said support platform.

5. An adjustable support assembly for supporting a keyboard so that the keyboard user's wrists will be in a substantially neutral position when the keyboard user is in an operating position relative to the keyboard, said support assembly comprising a support platform having an upper surface extending generally in a plane, a front edge and a rear edge, said front edge being closer to the keyboard user in said operating position than said rear edge, a bracket assembly for mounting said platform to a work surface, said bracket assembly having a top end connectable to said work surface and a bottom end, said support platform being connected to said bracket assembly for movement through a range of positions between a first position in which said support platform is proximate said top end of said bracket assembly and a second position in which said support platform is remote from said top end of said bracket assembly, a locking mechanism having a locked condition for locking said support platform with respect to said top end said bracket assembly at each position within said range of positions and a released condition for releasing said support platform for movement within said range of positions, and movement limiting means for limiting angular movement of said support platform relative to said bracket assembly in said locked condition so that said support platform in said locked condition is always oriented with said front edge higher than said rear edge.

6. The adjustable support assembly as claimed in claim 5, wherein said support assembly has a component of movement between said first and second positions in a substantially vertical direction.

7. The adjustable support assembly as claimed in claim 5, wherein said support platform is movable in a substantially vertical direction between said first and second positions.

8. The adjustable support assembly as claimed in claim 5, further comprising a base fixedly mountable to said work surface and having a front end and a rear end, said bracket assembly being slideably connectable to said base for movement between a retracted position in which said front edge of said support platform is at a first spaced distance from said rear end of said base and an extended position in which said front edge of said support platform is at a spaced distance from said rear end of said base which is greater than said first spaced distance.

9. The adjustable support assembly as claimed in claim 5, wherein said support platform includes a palm rest extending along said front edge, said palm rest having a support surface located at a spaced distance above said upper surface of said support platform.

10. The adjustable support assembly as claimed in claim 9, wherein said support surface of said palm rest lies in a plane extending generally parallel to said upper surface of said support platform.

11. The adjustable support assembly as claimed in claim 9, wherein said support platform has a pair of lateral edges extending between said front and rear edges, said lateral edges being devoid of sidewalls projecting upwardly from said upper surface.

12. An adjustable support assembly for supporting a keyboard so that the keyboard user's wrists will be in a substantially neutral position when the keyboard user is in an operating position relative to the keyboard, said support assembly comprising a support platform having an upper surface extending generally in a plane, a front edge and a rear edge, said front edge being closer to the keyboard user in said operating position than said rear edge, a bracket assembly for mounting said support platform to a work surface, said bracket assembly having a top end connectable to said work surface and a bottom end, said support platform being connected to said bracket assembly for movement in a direction transverse to said plane through a range of positions between a first position in which said support platform is proximate said top end of said bracket assembly and a second position in which said support platform is remote from said top end of said bracket assembly, a locking mechanism having a locked condition for locking said support platform with respect to said top end of said bracket assembly at each position within said range of positions and a released condition for releasing said support platform for movement within said range of positions, and movement limiting means for limiting angular movement of said support platform relative to said bracket assembly in said locked condition so that said support platform in said locked condition is always oriented with said front edge higher than said rear edge.

13. The adjustable support assembly as claimed in claim 12, further comprising a base fixedly mountable to said work surface and having a front end and a rear end, said bracket assembly being slideably connectable to said base for movement between a retracted position in which said front edge of said support platform is at a first spaced distance from said rear end of said base and an extended position in which said front edge of said support platform is at a spaced distance from said rear end of said base greater than said first spaced distance.

14. The adjustable support assembly as claimed in claim 12, wherein said support platform includes a palm rest extending along said front edge, said palm rest having a support surface located at a spaced distance above said upper surface of said support platform.

15. The adjustable support assembly as claimed in claim 14, wherein said support surface of said palm rest lies in a plane extending generally parallel to said upper surface of said support platform.

16. The adjustable support assembly as claimed in claim 12, wherein said support platform has a pair of lateral edges extending between said front and rear edges, said lateral edges being devoid of sidewalls projecting upwardly from said upper surface.

17. An adjustable support assembly for supporting a keyboard so that the keyboard user's wrists will be in a substantially neutral position when the keyboard user is in an operating position relative to the keyboard, said support assembly comprising a support platform having an upper surface extending generally in a plane, a front edge and a rear edge, said front edge being closer to the keyboard user in said operating position than said rear edge, a bracket assembly for mounting said support platform to a work surface, said bracket assembly including a base fixedly mountable to said work surface and having a front end and a rear end, a first portion connected to said base, and a second portion connected to said support platform, said support platform being movable in a first direction transverse to said plane through a range of positions between a first position in which said support platform is proximate said base and a second position in which said support platform is remote from said base, said support platform being movable in a second direction different from said first direction between a retracted position in which said front edge of said support platform is at a first spaced distance from said rear end of said base and an extended position in which said front edge of said support platform is at a spaced distance from said rear end of said base greater than said first spaced distance, a locking mechanism having a locked condition for locking said support platform in fixed positions with respect to said base and a released condition for releasing said support platform for movement with respect to said base, and movement limiting means for limiting angular movement of said support platform relative to said base in said locked condition so that said support platform in said locked condition is always oriented with said front edge higher than said rear edge.

* * * * *

UNITED STATES PATENT AND TRADEMARK OFFICE
CERTIFICATE OF CORRECTION

PATENT NO. : 5,582,375

DATED : December 10, 1996

INVENTOR(S) : Martin

It is certified that error appears in the above-identified patent and that said Letters Patent is hereby corrected as shown below:

Column 3, line 3, delete "angle of" and insert --yet which presets the palm rest and the--.
Column 3, line 14, delete "tray" and insert --support--.
Column 3, line 39, after "elevational" insert --view--.
Column 3, line 58, "assembly support" should read --support assembly--.
Column 4, line 1, after "provide" insert --this--.
Column 4, lines 3-4, "palm support and wrist" should read --palm and wrist support--.
Column 4, line 5, "Upstanding" should read --upstanding--.
Column 4, line 11, "pain" should read --pair--.
Column 4, line 12, after "and" insert --27--.
Column 5, lines 25-26, "(shown in FIG. 11) position" should read --position (shown in FIG. 11)--.
Column 5, line 48, after "are" insert--,--.
Column 5, line 56, after "panel" insert --60--.
Col. 5, lines 57-58, "motivating member" should read --mounting member 16--.
Column 7, line 38, "assembly support" should read --support assembly--.
Column 7, line 47, "maybe" should read --may be--.
Column 8, line 54, after "end" insert --of--.

Signed and Sealed this

Third Day of June, 1997

*Attest:*

*Attesting Officer*

Bruce Lehman

BRUCE LEHMAN

*Commissioner of Patents and Trademarks*